United States Patent [19]

Hoener

[11] Patent Number: 4,631,943

[45] Date of Patent: Dec. 30, 1986

[54] LOCKING KEY WITH MEMORY

[76] Inventor: Jost Hoener, Buhlackerstr. 19/B, 7801 Vöstetten, Fed. Rep. of Germany

[21] Appl. No.: 614,436

[22] Filed: May 25, 1984

[51] Int. Cl.[4] ..... E05B 41/00; E05B 19/04

[52] U.S. Cl. ..... 70/395; 70/408; 70/432

[58] Field of Search ..... 70/395, 408, 432, 433, 70/436, 437; 116/309, 313

[56] References Cited

U.S. PATENT DOCUMENTS

| | | | |
|---|---|---|---|
| 2,176,465 | 10/1939 | Merkl | 70/436 X |
| 2,198,484 | 4/1940 | Merkl | 70/432 X |
| 2,373,893 | 4/1945 | Hoenger | 70/432 X |
| 2,418,046 | 3/1947 | Oberfield | 70/436 X |
| 4,432,218 | 2/1984 | Hoener | 70/395 |
| 4,440,011 | 4/1984 | Klein | 70/432 X |

FOREIGN PATENT DOCUMENTS 151029 5/1904 Fed. Rep. of Germany .

*Primary Examiner*—Robert L. Wolfe
*Assistant Examiner*—Russell W. Illich
*Attorney, Agent, or Firm*—Karl F. Ross; Herbert Dubno

[57] ABSTRACT

A locking key, designed to preserve an indication of the lock-shifting (opening or closing) operation last performed, has a shank with an extension shaft rotatably received in an adjoining head, the relative rotation of the shank and the head being limited to 90° or 180° by a retaining pin in the head coacting with a part-circular recess on the shaft. The pin and the recess also serve to hold the head in a fixed axial position with reference to the shank. A spring-loaded detent in the shaft or elsewhere inside the head serves to index the two key portions in either of their limiting relative positions.

13 Claims, 10 Drawing Figures

Fig. 1
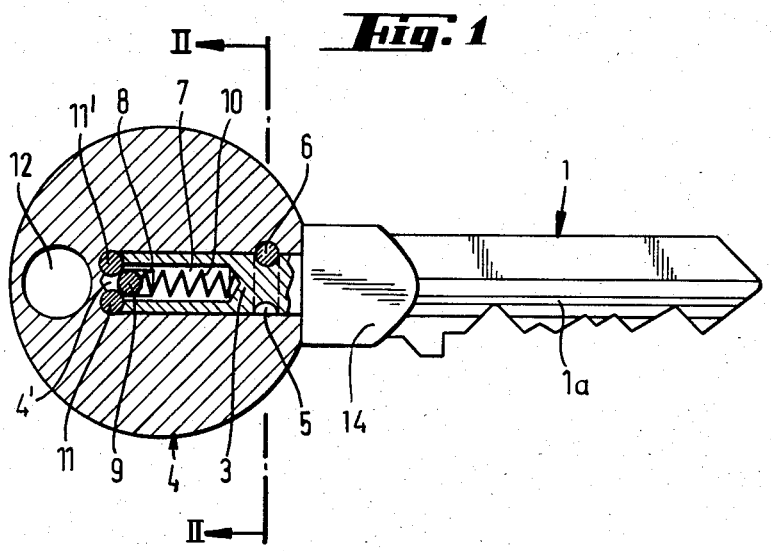
Fig. 2
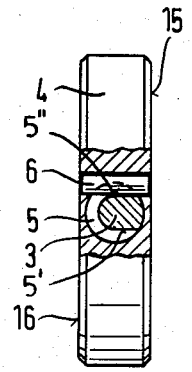
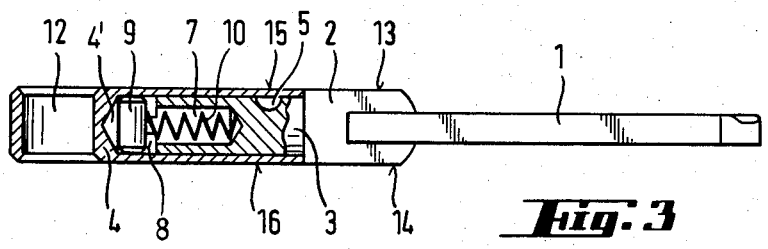
Fig. 3

LOCKING KEY WITH MEMORY

FIELD OF THE INVENTION

My present invention relates to a locking key with a memory, designed to preserve an indication of the lock-shifting operation last performed in order to remind a user whether the corresponding lock has been left open or has been closed.

BACKGROUND OF THE INVENTION

A locking key of this description is the subject matter of my prior U.S. Pat. No. 4,432,218. According to that prior patent, a bit-carrying shank and an operating head of the key are relatively rotatable through 90° or 180°. The shank has an extension in the form of a bolt which is axially threaded into the head and carries a terminal element on a free end projecting from that head. A pair of transverse shoulders respectively formed on the shank and on the terminal element confront a pair of lands on the head, the separation of the shoulders exceeding that of the lands whereby a gap exists between one shoulder and the corresponding land in either limiting position of relative rotation. The pitch of the bolt thread is so chosen that the gap shifts from one shoulder to the other upon a relative rotation by the desired fraction of a turn, whereupon the shank is positively entrained by the head when the latter continues to be rotated in the same sense.

While the key of my prior patent operates satisfactorily in most instances, it may happen that the exertion of excessive force in the opening or the closing of the lock causes one of the lands to become wedged against the associated shoulder so as to be disengageable therefrom only by a torque exceeding that which is needed to reverse the position of the lock. In that case the relative angular position of the head and the shank, which may be marked by distinctive symbols or colors, no longer correctly indicates to the user the lock-shifting operation last performed.

OBJECT OF THE INVENTION

The object of my present invention is, therefore, to provide an improved locking key of the parallel type referred to in which such wedging or freezing of relative position cannot occur.

SUMMARY OF THE INVENTION

My improved locking key again comprises a head member grippable by the fingers of a user and a shank member provided with a lock-operating bit, the two members being joined together for limited relative rotation between terminal positions preferably 90° or 180° apart. The shank member, for this purpose, is rigid with a shaft that is rotatably lodged in a central bore of the head member, this shaft—like the threaded bolt of my prior patent—having an axis parallel to a pair of substantially flat faces of the head member. A retaining element in the head member engages in a part-circular recess of the shaft for limiting the relative rotatability of the two members to, preferably, a whole number of quarter turns amounting in no case to a full turn. The retaining element and the recess also maintain the two members in a fixed relative axial position. The head further contains a spring-loaded detent which is engageable with a coacting formation for indexing the members in either of their two limiting positions of relative rotation.

The retaining element and the detent within the head may have the form of pins, though the detent could also be a ball. In either instance, the detent will make only line contact rather than area contact with the coacting formation engaged in either limiting position so as to obviate the risk of jamming. The use of a spring-loaded detent facilitates a possible adjustment of the biasing force acting upon that detent in order to accommodate different operating conditions.

BRIEF DESCRIPTION OF THE DRAWING

The above and other features of my invention will now be described in detail with reference to the accompanying drawing in which:

FIG. 1 is a side-elevation view, partly in section, of a locking key embodying my invention;

FIG. 2 is a cross-sectional view taken on the line II—II of FIG. 1;

FIG. 3 is a top view, partly in section, of the key of FIGS. 1 and 2;

SPECIFIC DESCRIPTION

Figure 4:
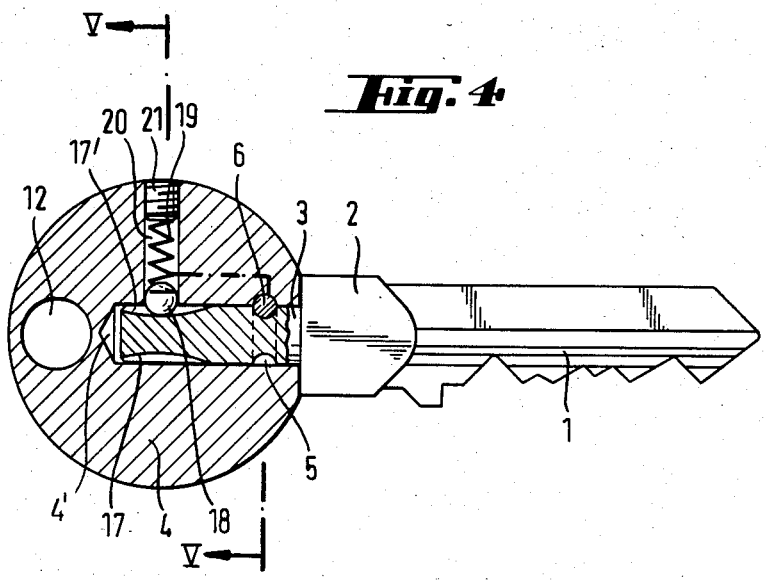
FIG. 4 is a view similar to FIG. 1, showing a modification.
Figure 5:
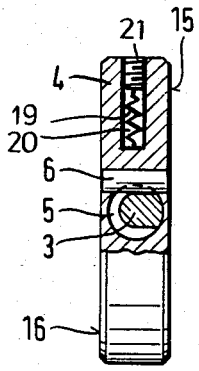
FIG. 5 is a cross-sectional view taken on the line V—V of FIG. 4.
Figure 6:
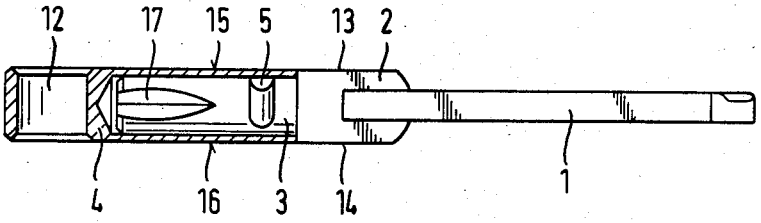
FIG. 6 is a part-sectional top view similar to FIG. 3 but pertaining to the embodiment of FIGS. 4 and 5.

The locking key shown in FIGS. 1–3 comprises a shank member 1, with a bit 1*a*, and a head member 4 having a blind axial bore 4' into which a shaft 3 in line with member 1 projects. The shaft 3 is fixedly secured to shank 1 through the intermediary of a connector 2 with lateral faces 13, 14 which in the illustrated position are flush with respective flat faces 15 and 16 of head 4. Shaft 3 extends in bore 4' well beyond the center of the circularly contoured head and is provided near the entrance of that bore with a recess in the form of a U-shaped peripheral groove 5 extending around the shaft axis over an arc of 180°. A transverse cylindrical holding pin 6, fixedly lodged in head 4 skew to the shaft axis, has a radius substantially equal to the depth of that groove in which it comes to rest against the solid core of the shaft as best seen in FIG. 2. The groove 5 has two parallel extremities 5' and 5'', the latter resting against the pin 6 in the illustrated relative position of members 1 and 4. Upon counterclockwise rotation of head 4 by half a turn from the position of FIG. 2, pin 6 comes to lie within groove extremity 5'. The groove 5 and the shaft 6 limit such relative rotation to an arc of 180° beyond which the shank 1 will be entrained by the head 4; such entrainment in the opposite sense will also take place when the head is turned clockwise by the user from the limiting position of FIG. 2.

Shaft 3 is further provided with an axially extending blind bore 7 and with two parallel slots 8 at the open end of that bore, these slots accommodating an indexing pin 9 paralleling the holding pin 6 in either of its limiting position. Pin 9, whose diameter substantially equals the width of slots 8 and which is axially shiftable to an extent determined by the length of these slots, is biased outward by a coil spring 10 lodged in bore 7. Two further pins 11 and 11', of substantially the same length and diameter as, pin 9 and parallel to pin 6, are fixedly disposed in respective recesses of head 4 at the open end of bore 4'. The pins 11 and 11' are separated by a gap which is smaller than the diameter of pin 9; thus, spring 10 presses pin 9 into that gap in the illustrated limiting position as well as in the alternate position separated therefrom by half a turn. In these two positions, pin 9 is in line contact with pins 11, 11' which resist but do not prevent a relative rotation of the head in the permitted direction. That head is shown further provided with a hole 12, in line with bore 4', for the passage of a key ring.

As described in my prior patent, the faces 13, 14 of connector 2 and the faces 15, 16 of head 4 can be provided with distinctive markings, e.g. colors, which match in one but not in the other limiting position to inform the user whether the key, extracted from a lock, has left that lock in its closed or open condition. Numerals or letters could be used to the same effect.

It will be apparent that a part-circular groove such as that shown at 5 may be reduced to a quadrant so as to limit the relative rotation of the head and shank members to 90°. In such an instance, as likewise described in my prior patent, the head will lie perpendicular to the plane of the shank when the lock has been left open, an occurrence of which the user may be reminded by the fact that the key won't then readily fit into a carrying case.

The several pins shown in FIG. 1 are preferably made from hardened steel.

The magnitude of the torque indexing the shank and the head in either of their limiting relative positions depends on the strength of the spring 10. A replacement of that spring by a weaker or stronger one is possible by knocking out the pin 6 and extracting the shaft 3 from the head 4.

In the embodiment of FIGS. 4–7, head 4 additionally has a transverse bore 20 terminating at the axial bore 4' which again accommodates the shaft 3 of shank 1. The shaft, which here too is provided with a U-shaped peripheral groove 5 coacting with a fixed holding pin 6, lacks the bore 7 of the preceding embodiment but has a pair of diametrically opposite, axially extending depressions 17, 17' one of which is engaged by a ball 18 in either of the two limiting relative positions of head 4 and shank 1. Ball 18, serving as a detent, is movable inside bore 20 and is loaded by a coil spring 19 held compressed within that bore by a plug 21 closing the outer end of the bore, as by being screw-threaded into same. The depressions 17, 17' are quite shallow, with a maximum depth less than the radius of ball 18, and are able to cam that ball outward within bore 20 when members 1 and 4 are relatively rotated against the resistance of a lock so as to leave their limiting position. The torque required for displacing the ball 18 from the engaged depression can again be changed, if necessary, by replacing the biasing spring 19 upon removal of plug 21.

Figure 7:
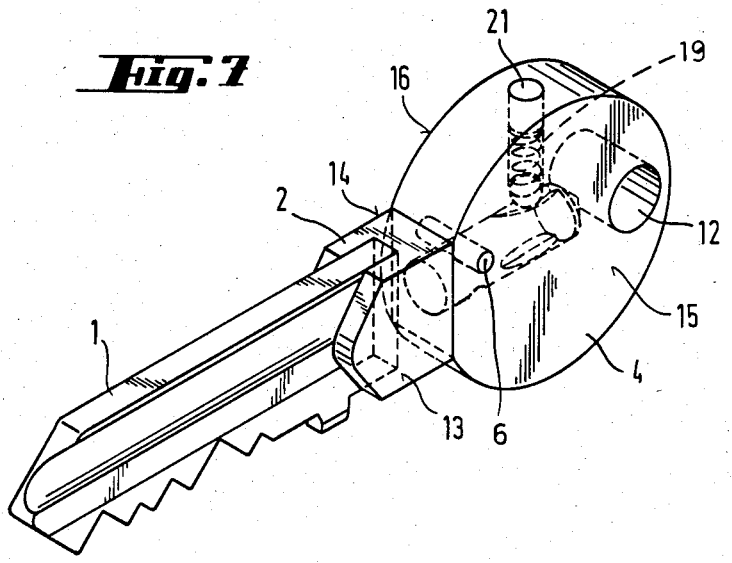
FIG. 7 is a perspective view of the key shown in FIGS. 4–6.

Suitable symbols on the aligned faces 13, 15 and 14, 16 of connector 2 and head 4, e.g. a pair of arrows as shown in FIG. 7, indicate to the user whether the lock has been left open or closed.

Figure 8:
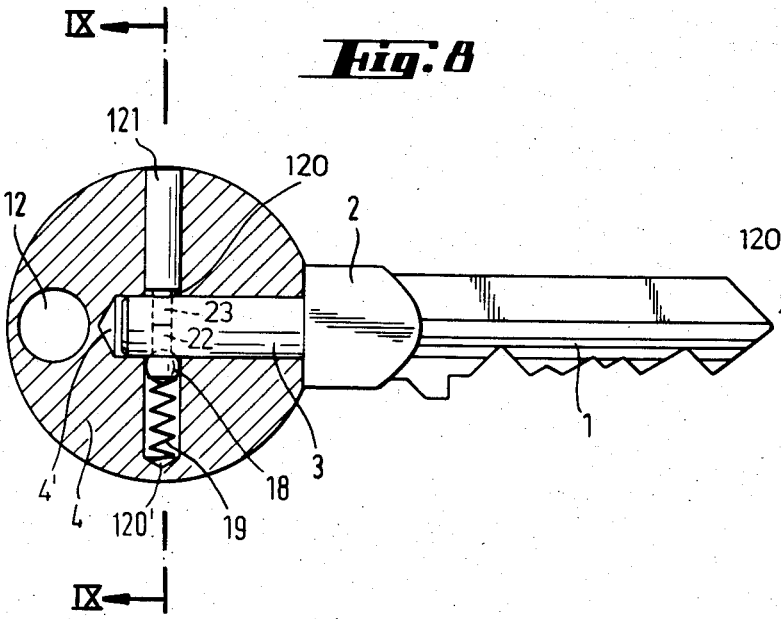
FIG. 8 is a further view similar to FIG. 1, showing an additional embodiment.
Figure 9:
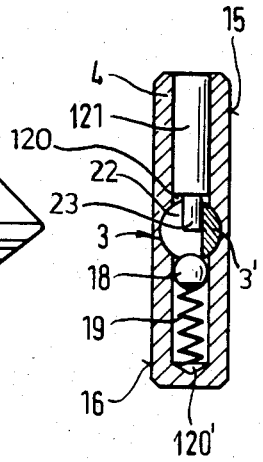
FIG. 9 is a cross-sectional view taken on the line IX—IX of FIG. 8.
Figure 10:
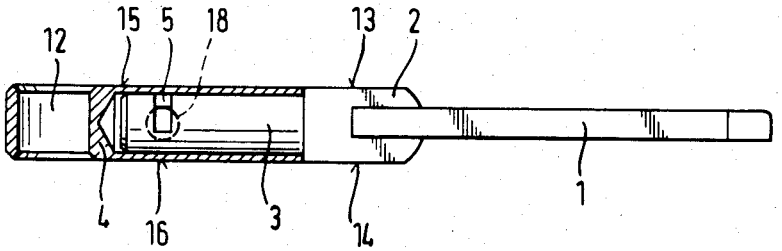
FIG. 10 is a part-sectional top view, again similar to FIG. 3, pertaining to the embodiment of FIGS. 8 and 9.

In FIGS. 8–10 I have shown a modified key whose head 4 is provided with indexing means similar to those of FIGS. 4–7, namely a ball 18 loaded by a spring 19 which is received in a transverse bore 120'. That bore is a blind extension of a bore 120 intersecting the axial bore 4', its peripherally accessible part being occupied by a holding pin 121 with a reduced cylindrical tip 23 which projects into a recess in the form of a segmental incision 22 of shaft 3; tip 23, whose diameter corresponds to the axial width of incision 22, terminates at the axis of the shaft and rests in either limiting position against a residual core portion 3' which defines a chord offset from that axis by half the diameter of tip 23 whereby the segmental incision extends over more than half the cross-section of shaft 3. Together with that incision, therefore, tip 23 of pin 121 establishes a fixed relative axial position of key members 1 and 4 while also limiting their relative rotation to 180°. Ball 18, whose diameter exceeds the width of incision 22, partly engages in that incision and rests against an edge of core portion 3' diametrically opposite that engaged by tip 23 so as to tend to preserve the limiting position last established from which members 1 and 4 can be relatively rotated with a torque sufficient to overcome the countervailing force of biasing spring 19. Thus, recess 22 replaces the holding groove of FIGS. 1–7 while also serving as a formation coacting with detent 18.

Pin 121, which is not under radial pressure, can be retained in bore 120 by friction but could also be screwed into that bore like the plug 21 of the preceding embodiment. A withdrawal of that pin frees the shaft 3 for removal from head 4 and thus allows a replacement of spring 19 if this should be desired.

I claim:

1. A locking key comprising:

a head member grippable by fingers of a user;

a shank member provided with a lock-operating bit, said shank member being rigid with a shaft rotatably lodged in a central bore of said head member, said shaft having an axis parallel to and situated completely between a pair of substantailly flat faces of said head member;

a holding pin in said head member, said pin disposed always perpendicular to said shaft faces and offset from said shaft axis, said pin engaging in a part-circular recess of said shaft for limiting the relative rotatability of said members to less than a full turn, said pin and said recess also maintaining said members in a fixed relative axial position; and a spring-loaded detent inside said head engageable with a coacting formation for indexing said members in either of two limiting positions of relative rotation, said recess being a part-circular peripheral groove on said shaft with linear extremities of the groove occupied by said holding pin in respective limiting positions spaced a whole number of quandrants apart.

2. A locking key as defined in claim 1 wherein said groove is U-shaped and enables a relative rotation of 180°.

3. A locking key as defined in claim 1 wherein said holding pin is cylindrical and said groove is of semicircular cross-section with a radius substantially equaling that of said holding pin.

4. A locking key as defined in claim 3 wherein said head member is provided with a transverse bore parallel to said faces extending at least to said central bore, said detent and a spring associated therewith being lodged in said transverse bore, said coacting formation being disposed on said shaft.

5. A locking key as defined in claim 4 wherein said detent is a ball.

6. A locking key as defined in claim 5 wherein said coacting formation is a pair of diametrically opposite axially extending depressions on the periphery of said shaft.

7. A locking key as defined in claim 5 wherein said coacting formation comprises a generally sectoral transverse incision on said shaft.

8. A locking key as defined in claim 7 wherein said transverse bore has an extension beyond said central bore, said retaining element being lodged in said extension and engaging in said incision, the latter extending beyond said axis and constituting said recess.

9. A locking key as defined in claim 4 wherein said transverse bore is closed by a plug toward the circumference of said head member.

10. A locking key as defined in claim 8 wherein said plug is threadedly held in said transverse bore.

11. A locking key comprising:

a head member grippable by fingers of a user;

a shank member provided with a lock-operating bit, said shank member being rigid with a shaft rotatably lodged in a central bore of said head member, said shaft having an axis parallel to and situated completely between a pair of substantially flat faces of said head member;

a holding pin in said head member said pin disposed always perpendicular to said shaft faces and offset from said shaft axis, said pin engaging in a part-circular recess of said shaft for limiting the relative rotatability of said members to less than a full turn, said pin and said recess also maintaining said members in a fixed relative axial position; and a spring-loaded detent inside said head engageable with a coacting formation for indexing said members in either of two limiting positions of relative rotation, said shaft being provided with an axially extending blind bore, said detent being lodged in said blind bore and projecting partly from an end thereof under spring pressure in either of said limiting positions upon engaging said coacting formation.

12. A locking key as defined in claim 11 wherein said shaft is provided at said end with two parallel slots flanking said bore, said detent being an indexing pin with ends guided in said slots.

13. A locking key as defined in claim 12 wherein said coacting formation is a gap between two fixed pins in said head member confronting said shaft and paralleling said indexing pin in said limiting positions.

* * * * *